US005943794A

United States Patent [19]

Gelsomini

[11] Patent Number: 5,943,794

[45] Date of Patent: Aug. 31, 1999

[54] GOLF SHOES WITH ALIGNED TRACTION MEMBERS

[75] Inventor: Pamela A. Gelsomini, Quincy, Mass.

[73] Assignee: Nordstrom, Inc., Seattle, Wash.

[21] Appl. No.: 08/914,287

[22] Filed: Aug. 18, 1997

[51] Int. Cl.[6] ..... A43B 5/00; A43B 23/28

[52] U.S. Cl. ..... 36/127; 36/59 C; 36/67 R

[58] Field of Search ..... 36/59 R, 59 C, 36/67 R, 67 A, 127, 134, 129

[56] References Cited

U.S. PATENT DOCUMENTS

| | | | |
|---|---|---|---|
| D. 61,473 | 9/1922 | Mason | D2/955 |
| D. 160,561 | 10/1950 | Steinhilber | D2/955 |
| D. 247,692 | 4/1978 | Inohara | D2/962 |
| D. 275,147 | 8/1984 | Philpott | D2/954 |
| D. 278,382 | 4/1985 | Chen | D2/955 |
| D. 310,294 | 9/1990 | Peterson | D2/955 |
| D. 318,946 | 8/1991 | Granatelli | D2/955 |
| D. 371,453 | 7/1996 | Deacon et al. | D2/962 |
| D. 372,355 | 8/1996 | Deacon et al. | D2/962 |
| D. 373,675 | 9/1996 | McMullin | D2/962 |
| D. 378,013 | 2/1997 | McMullin | D2/962 |
| D. 380,076 | 6/1997 | McMullin | D2/962 |
| 1,355,827 | 10/1920 | Finneran | 36/59 R |
| 1,594,056 | 7/1926 | Floyd | 36/59 R |
| 1,631,741 | 6/1927 | Lazzari et al. | 36/59 R |
| 1,985,775 | 12/1934 | Goldenberg | 36/59 R |
| 3,747,237 | 7/1973 | Wilowski | 36/59 C |
| 4,367,600 | 1/1983 | Cross, III et al. | 36/127 |
| 4,527,345 | 7/1985 | Lopez | 36/127 |
| 4,667,425 | 5/1987 | Effler et al. | 36/59 R |
| 4,689,901 | 9/1987 | Ihlenburg | 36/59 C |
| 4,885,851 | 12/1989 | Peterson | 36/127 |
| 5,077,915 | 1/1992 | Gross | 36/114 |
| 5,201,126 | 4/1993 | Tanel | 36/59 R |
| 5,259,129 | 11/1993 | Deacon et al. | 36/127 |
| 5,367,793 | 11/1994 | Deacon et al. | 36/127 |
| 5,623,774 | 4/1997 | Abbey | 36/134 |
| 5,711,094 | 1/1998 | Grossman | 36/127 |

FOREIGN PATENT DOCUMENTS

0768048A2 4/1997 European Pat. Off. .

OTHER PUBLICATIONS

Catalog from Eurosport, 431 U.S. Highway 70A East, Hillsborough, NC 27278–9912, ,Fall vol. 2 1997, cover and pp. 10, 12, 13 and 18.

Catalog from Soccer World, 31055 Huntwood Avenue, Hayward, California 94544, Summer 1997, cover and pp. 3 and 58.

Catalog from Acme Soccer & Widget Works, One Acme Plaza, P.O. Box 811, Carrboro, NC 27510–0811, Late Summer 1997, cover and p. 16.

*Primary Examiner*—M. D. Patterson
*Attorney, Agent, or Firm*—Seed and Berry LLP

[57] ABSTRACT

An improved golf shoe and sole is provided. In a preferred embodiment, a pair of golf shoes comprising a right shoe and a left shoe, the right shoe having a different arrangement of traction elements on the sole thereof than the left shoe. For right-handed golfers, the sole of the right shoe has a greater number of axial traction members which are aligned with an edge of the sole than transverse traction members which are positioned transverse to the edge of the sole. The right shoe accordingly resists pivotal motion. The left shoe has a greater number of transverse traction members than axial traction members so as to allow pivotal motion. The golf shoes accordingly allow the golfer to make a fuller back swing and to follow through more completely on the power stroke. The relative number of axial and transverse traction members on the left an right shoes may be reversed for left-handed golfers.

37 Claims, 8 Drawing Sheets

GOLF SHOES WITH ALIGNED TRACTION MEMBERS

TECHNICAL FIELD

The present invention is directed to an improved pair of golf shoes and golf shoe soles.

BACKGROUND OF THE INVENTION

Golfers typically wear specially designed golf shoes while playing on turf golf courses. The golf shoes are designed to fit comfortably on the golfer's feet and provide good traction to prevent the golfer from losing his or her balance on the potentially slick surface of the course. Accordingly, the soles of the golf shoes may be provided with spaced apart cleats which project downwardly therefrom to provide solid traction with the turf even if the turf is wet. These cleats are typically made of metal or hard plastic and placed at various locations around the shoe sole.

One problem with conventional golf shoes is that the cleats may tend to resist pivotal motion of the golfer's feet. As a result, the golfer's foot motion, particularly during the back swing, may be inhibited or altered. The power and accuracy of the golfer's swing may be reduced, and the golfer's game may suffer accordingly. Another problem with conventional golf shoes is that the shoes may not provide the proper balance of traction and stability which would permit the same pair of shoes to be used on both wet turf and a more rigid surface, such as a solid floor.

SUMMARY OF THE INVENTION

In brief, the present invention provides a pair of golf shoes and golf shoe soles with improved performance and usability both on and off the golf course. In a preferred embodiment, a pair of golf shoes having traction members arranged differently on one sole than the other is provided. One of the soles accordingly tends to restrict pivotal motion of the golf shoe to which it is attached, while the other sole tends to allow pivotal motion.

In one embodiment, the pair of soles comprises first and second soles, each having a heel portion, a toe portion forward of the heel portion, a first edge extending between the heel and toe portions, and a second edge extending between the heel and toe portions opposite the first edge. The pair of soles further comprises a plurality of traction members, each elongated along a traction member axis. The plurality of traction members includes at least one first traction member connected to and depending from the first sole. The traction member axis of the first traction member is generally transverse to at least one of the first and second edges of the first sole. The first sole further includes at least two second traction members connected to and depending therefrom. The traction member axes of the second traction members are aligned generally parallel with at least one of the edges of the first sole and a number of second traction members is greater than a number of first traction members so as to resist pivotal motion of the first sole relative to the ground. The soles further include at least one third traction member connected to and depending from the second sole. The traction member axis of the third traction member is aligned generally parallel with at least one of the edges of the second sole. The second sole further includes at least two fourth traction members connected to and depending therefrom. The traction member axes of the fourth traction members are generally transverse to at least one of the first and second edges of the second sole and a number of fourth traction members is greater than a number of third traction members to allow pivotal motion of the second sole relative to the ground.

In a further aspect of this embodiment, the traction members comprise a plurality of spaced apart traction elements, each traction element being elongated along the traction member axis. In one embodiment, the traction members have a tapered cross-sectional shape when cut by a plane generally perpendicular to the traction member axis. The tapered shape includes a narrow portion spaced away from the sole to which the traction member is connected.

In another embodiment of the invention, the heel portion of the sole includes two spaced apart traction elements, each traction element being elongated along an axis which is generally aligned with one of the edges of the heel portion. The heel portion further includes cleat members intermediate the traction elements. In a further aspect of this embodiment, the cleat members have a generally rounded cross-sectional shape when cut by a plane generally perpendicular to the heel portion.

The invention further provides a method for controlling motion of a golfer's feet. In one embodiment, the method comprises coupling at least one first elongated traction member to a first foot of the golfer. The first elongated traction member is elongated generally transverse to an edge of the first foot. The method further comprises coupling a number of second elongated traction members to the first foot of the golfer, the second elongated traction members being elongated generally parallel with an edge of the first foot and the number of second elongated traction members being greater than a number of first elongated traction members. The method further comprises coupling at least one third elongated traction member to a second foot of the golfer, the third elongated traction member being elongated generally parallel with an edge of the second foot, and coupling a number of fourth elongated traction members to the second foot, the fourth elongated traction members being elongated generally transverse to an edge of the second foot, the number of fourth elongated traction members being greater than a number of third elongated traction members. The method still further includes engaging the elongated traction members with the ground when the golfer swings a golf club, to resist pivotal motion of the first foot and allow pivotal motion of the second foot.

DETAILED DESCRIPTION OF THE INVENTION

Figure 1A:
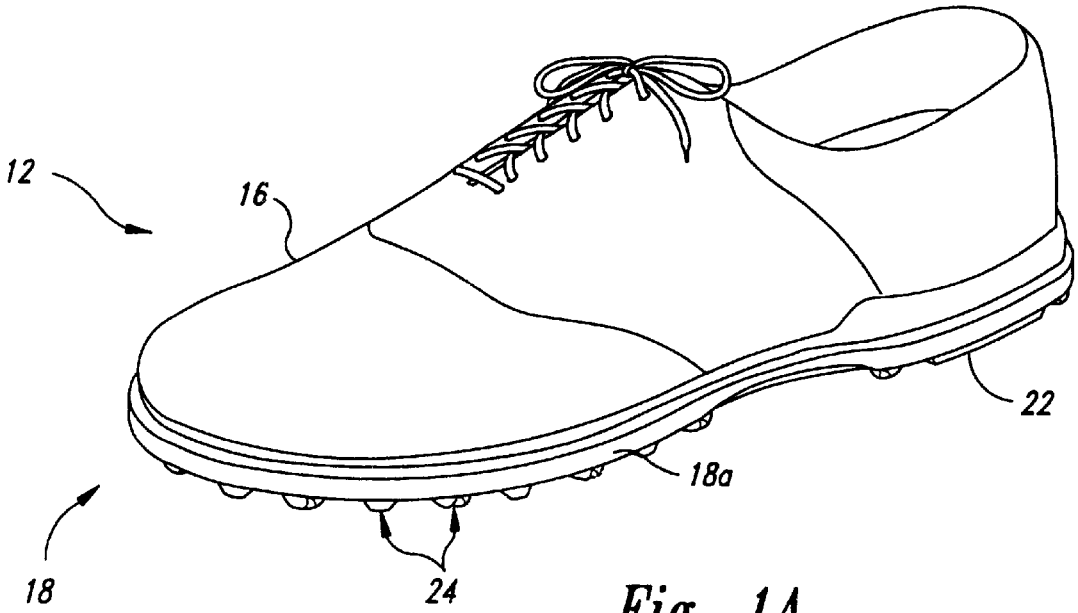
FIG. 1A is a top isometric view of a right golf shoe in accordance with an embodiment of the invention.
Figure 1B:
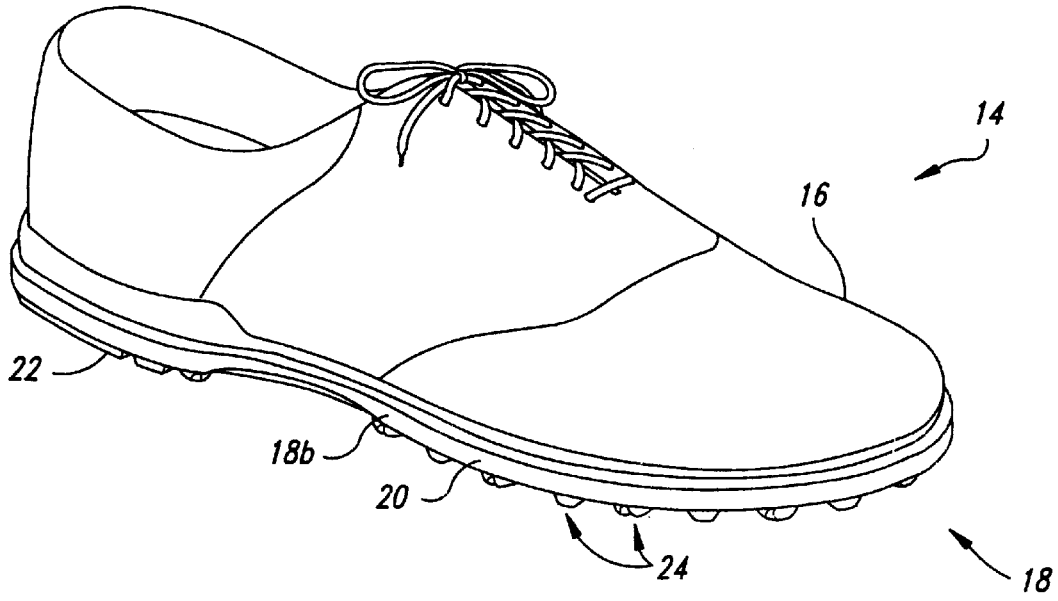
FIG. 1B is a top isometric view of a left golf shoe in accordance with an embodiment of the invention.

As discussed above, the present invention is directed toward improved golf shoe shoes and soles. In a preferred embodiment, a pair of golf shoes, and more specifically a pair of golf shoe soles, enhances the ability of a golfer to pivot one foot while maintaining the other foot in a generally stationary position. As shown in FIGS. 1A and 1B, a pair of golf shoes in accordance with an embodiment of the invention includes a right shoe 12 and a left shoe 14. Each shoe generally includes an upper 16 attached to a sole 18. The soles 18 include a right sole 18*a* attached to the upper 16 of the right shoe 12 and a left sole 18*b* attached to the upper 16 of the left shoe 14. Tile right sole 18*a* and left sole 18*b* each include traction members 22 and cleat members 24 which project downwardly from the soles to enhance the pivotability and stability of the shoes, as will be discussed in greater detail below.

Figure 2A:
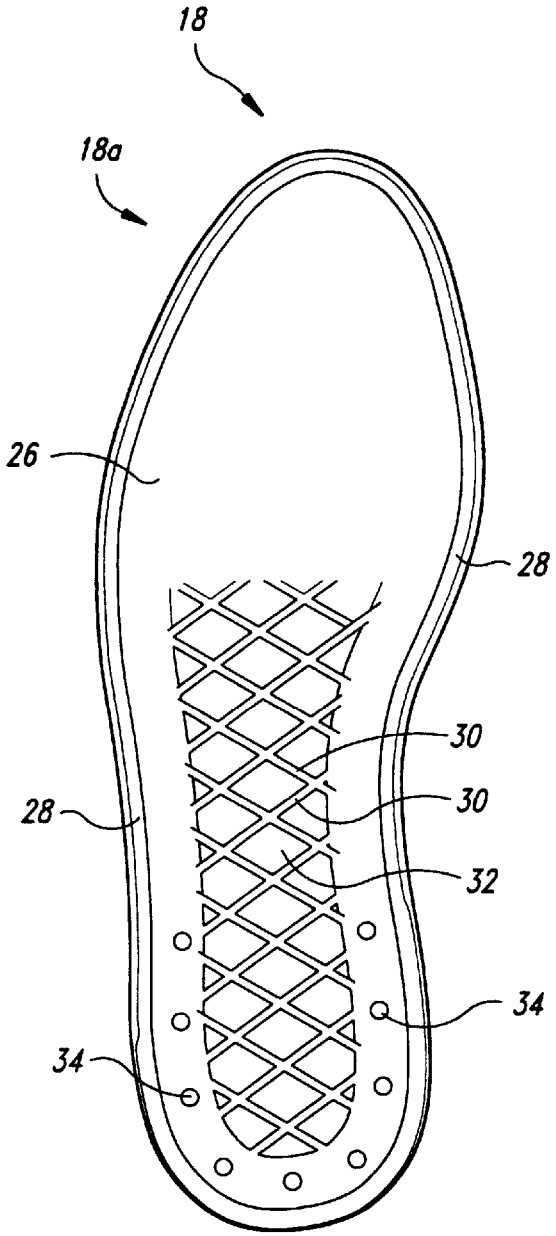
FIG. 2A is a top plan view of a right sole for a golf shoe in accordance with an embodiment of the invention.
Figure 2B:
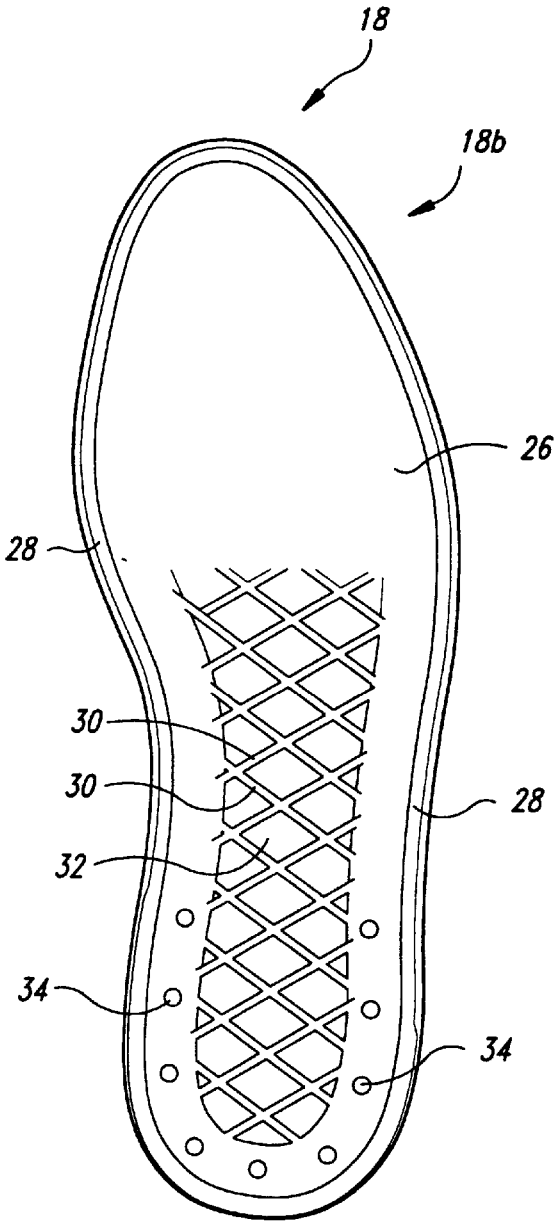
FIG. 2B is a top plan view of a left sole for a golf shoe in accordance with an embodiment of the invention.

FIGS. 2A and 2B are top plan views of the right sole 18*a* and left sole 18*b*, respectively. The soles 18 each include a base portion 26 which may comprise a plastic, rubber, or other suitable material or combination of materials that is sufficiently flexible to be comfortable to the golfer (not shown), and sufficiently rigid to provide support for the golfer's feet. A lip 28 extends upwardly from the base portion 26 around an outer periphery of the base portion. The lip 28 is sized to fit around the upper 16 (FIGS. 1A–B) when the upper is attached to the sole 18. The base portion 26 further includes support ridges 30 which project upwardly from an interior region of the base portion 26. The support ridges 30 support the upper 16 and may be sized to elevate a heel portion of the upper relative to a toe portion of the upper. The support ridges 30 are separated by wells 32 which are provided to reduce the overall weight of the soles 18. Mounting apertures 34 are provided around the periphery of the base portion 26 interior to the lip 28 for mounting the uppers 16 to the soles 18.

Figure 3A:
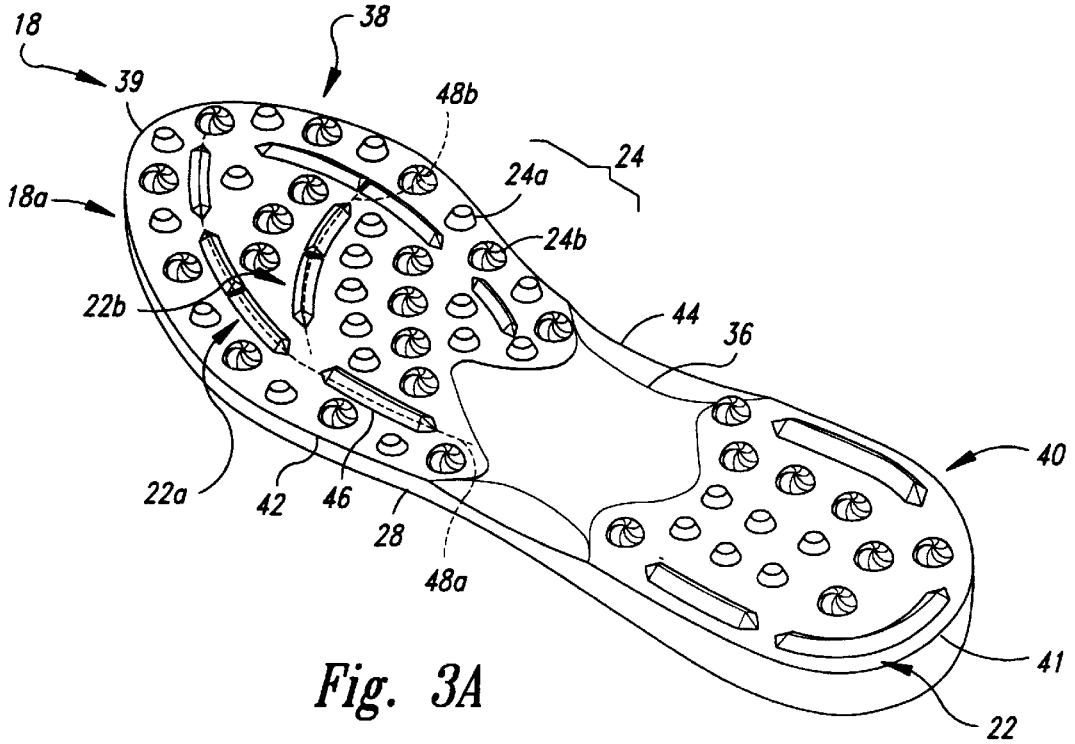
FIG. 3A is an isometric view of a lower surface of the right sole shown in FIG. 2A.
Figure 3B:
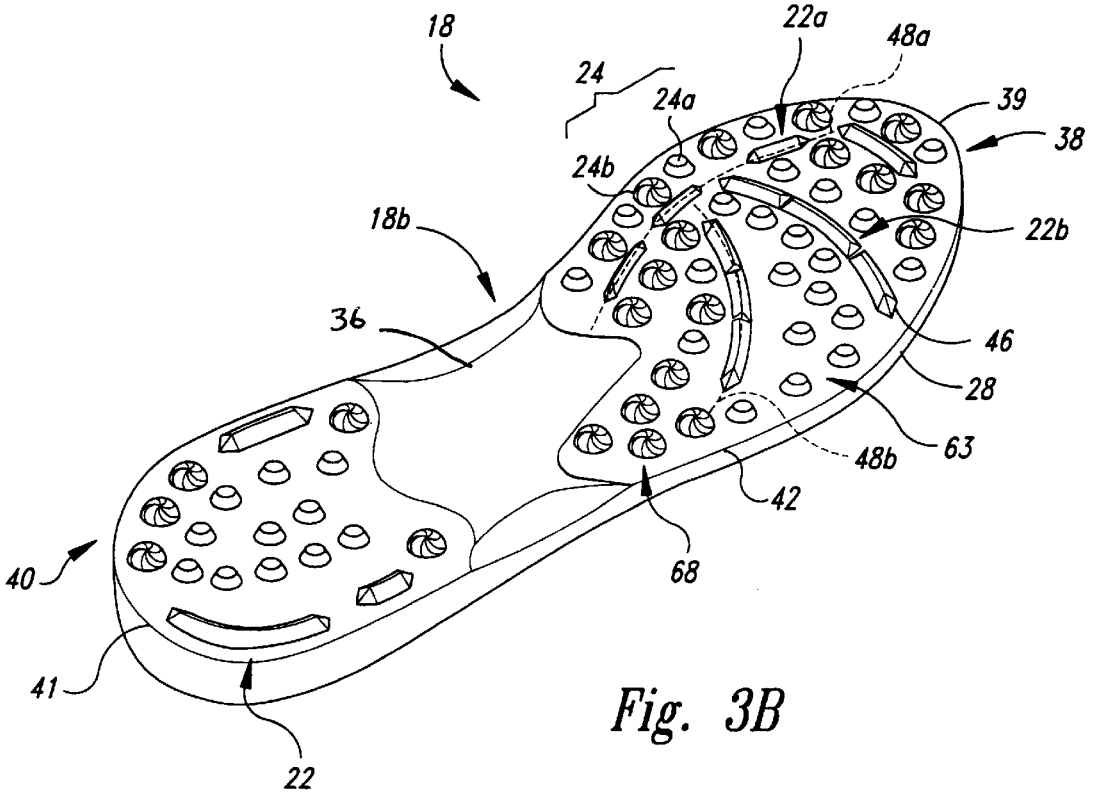
FIG. 3B is an isometric view of a lower surface of the left sole shown in FIG. 2B.
Figure 4A:
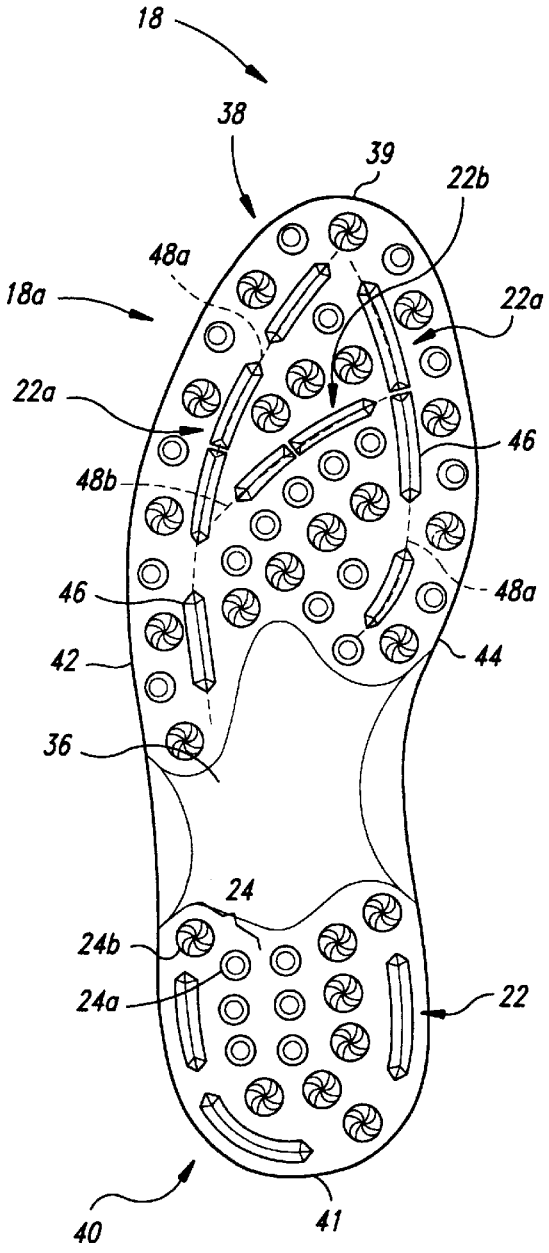
FIG. 4A is a bottom plan view of the lower surface of the right sole shown in FIG. 3A.
Figure 4B:
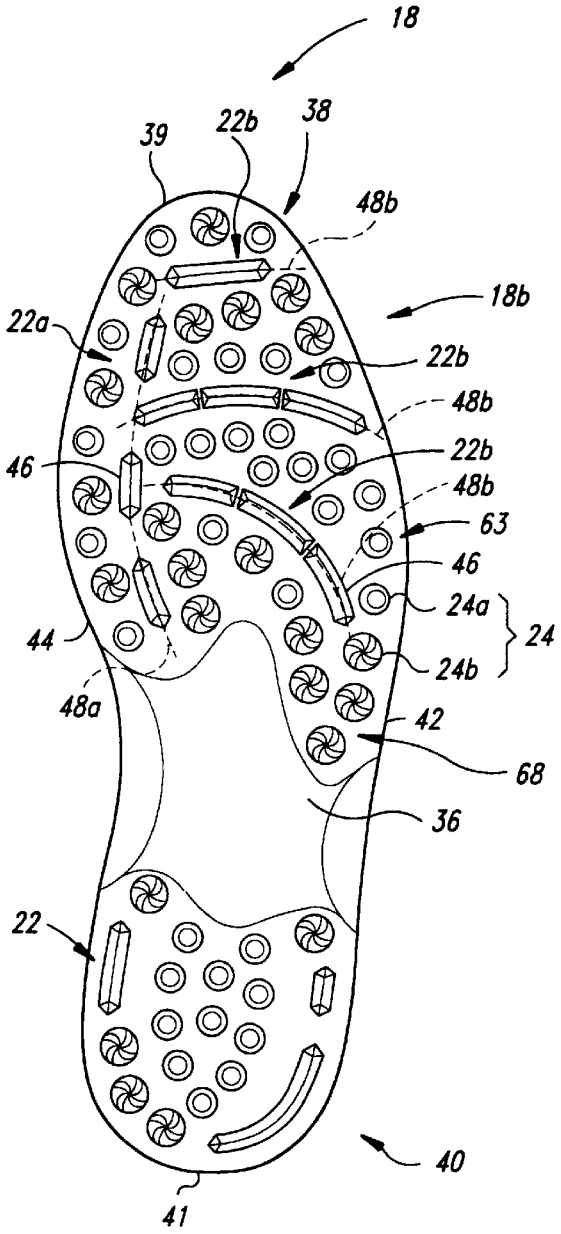
FIG. 4B is a bottom plan view of the lower surface of the left sole shown in FIG. 3B.

The soles 18 each have a lower surface 36, as shown in isometric view in FIGS. 3A–B and in plan view in FIGS. 4A–B. The lower surface 36 includes a toe portion 38 positioned forward of a heel portion 40. An outside edge 42 extends between the toe portion 38 and heel portion 40 along the outside of the soles 18. An inside edge 44 extends between the toe and heel portions 38 and 40 along the inside of the soles 18, opposite the outside edge 42. A rear edge 41 extends between the outside edge 42 and the inside edge 44 at the heel portion 40 and a forward edge 39 extends between the outside and inside edges of the toe portion 38.

The lower surface 36 further includes the traction members 22 and cleat members 24. The traction members 22 and cleat members 24 are preferably rigidly attached to the lower surface 36 and extend in a generally normal direction away from the lower surface so as to engage the ground and provide stability and/or pivotability to the soles 18, as discussed in greater detail below. The traction members 22 and cleat members 24 are preferably formed from a flexible, resilient material such as rubber, plastic, or other similar materials which are sufficiently rigid to provide support to the soles and sufficiently flexible in a lateral direction and compressible in the normal direction to be comfortable and to disengage from the ground when the golfer lifts his or her feet. In a preferred embodiment, the traction members 22 and cleat members 24 may comprise 3K Soft, a rubber compound having an abrasion level of 3000 NBS. 3K Soft is available from Jones & Vining of Nedham, Mass. The remainder of the soles 18 may comprise a rubber compound having an abrasion level of 90-110 NBS. The two rubber compounds may be integrally formed together in a single mold to provide a sole 18 which is generally rigid, and has traction members 22 and cleat members 24 which have a desired level of flexibility.

The traction members 22 may comprise a plurality of spaced apart traction elements 46 as shown in FIGS. 3A–B and 4A–B, and as discussed in greater detail below with reference to FIGS. 5A–C. The traction members 22 may also comprise continuous members, as discussed in greater detail below with reference to FIGS. 6A–B. In either case, the traction members 22 include axial traction members 22*a* and transverse traction members 22*b*. Each axial traction member 22*a* is elongated along an axial traction member axis 48*a*, shown schematically in dashed lines in FIGS. 3A–B and 4A–B. The axial traction member axis 48*a* may be aligned with the outside edge 42 or the inside edge 44 of the soles 18. The axial traction members 22*a* tend to resist lateral motion of the sole 18 transverse to the edges 42 and 44 when the axial traction members engage the ground. The axial traction members 22*a* also tend to resist pivotal motion of the soles 18 about an axis normal to the plane of the soles. Accordingly, the axial traction members 22*a* tend to enhance the stability of the sole 18 from which they depend.

Each transverse traction member 22*b* is elongated along a transverse traction member axis 48*b* which may be aligned transverse to the inside and/or outside edges 42 and 44. The transverse traction members 22*b* tend to allow transverse or pivotal motion of the soles 18. Accordingly, the axial traction members 22*a* and transverse traction members 22*b* may be used in combination to either restrict or permit pivotal motion of the sole 18 to which they are attached.

As shown in FIGS. 3A and 4A, the toe portion 38 of the right sole 18*a* has two axial traction members 22*a* and a single transverse traction member 22*b*. Because the number of axial traction members 22*a* exceeds the number of transverse traction members 22*b*, the right sole 18*a* tends to restrict pivotal motion of the right shoe 12. Conversely, as shown in FIGS. 3B and 4B, the toe portion 38 of the left sole 18*b* has a single axial traction member 22*a* and three transverse traction members 22*b*. Because the number of transverse traction members 22*b* exceeds the number of axial traction members 22*a*, the left sole 18*b* tends to allow pivotal motion of the left shoe 14. In other embodiments, different absolute numbers of axial traction members 22*a* and transverse traction members 22*b* are used, as discussed below with reference to FIGS. 7A–B, so long as a greater number of axial traction members are used where pivotal motion is to be restricted and a greater number of transverse traction members are used where pivotal motion is to be unrestricted.

One advantage of the soles 18*a* and 18*b* shown in FIGS. 1A–B, 3A–B, and 4A–B is that the traction members 22 are arranged to promote stability of the right shoe 12 and pivotability of the left shoe 14. This is advantageous because it allows a right-handed golfer to more easily pivot his left shoe 14 as he swings his or her golf club backward in a back swing motion, prior to striking a golf ball. At the same time, the golfer's right shoe 12 resists pivotal motion and stabilizes the golfer's right foot as he or she pivots off the left foot. This is advantageous because a typical golfer may shift 90% of his or her weight to the right foot during the backswing. As a result, the golfer's back swing may be less restricted, allowing the golfer to more completely extend the back swing and deliver a more powerful forward stroke. It is believed that the golfer's forward stroke may be made even more powerful and accurate because the golfer's right foot remains stable as he or she enters the forward stroke. The golfer accordingly has a more stable base from which to pivot as the golfer's weight is shifted in a forward direction during the course of the swing.

A further advantage of the golf shoe soles 18 shown in FIGS. 3A–B and FIGS. 4A–B is that, while each sole emphasizes either stability or pivotability, both soles have traction members 22 positioned to provide at least some degree of stability and at least some degree of pivotability. Accordingly, the right sole 18*a*, includes a transverse traction member 22*b* and does not completely restrict pivotal motion. Similarly, the left sole 18*b* includes an axial member 22*a* to provide a degree of stability. This feature is advantageous because, while the golfer may wish to emphasize pivotal motion in one foot and stability in the other, both feet may require a level of both stability and pivotability during different phases of the golfer's back swing and forward stroke.

As shown in FIGS. 3A–B and 4A–B, the right sole 18*a* and left sole 18*b* have traction members 22 configured for a right-handed golfer. In another embodiment, the configurations of the traction members 22 on the right sole 18*a* and the left sole 18*b* may be interchanged. This alternate embodiment may be desirable for left-handed golfers who wish to have a more stable left shoe 14 and a more pivotable right shoe 12. Accordingly, a further advantage of the golf shoe soles 18 shown in FIGS. 3A–B and 4A–B is that the soles may be designed to aid either a right-handed or left-handed golfer.

Figure 5A:
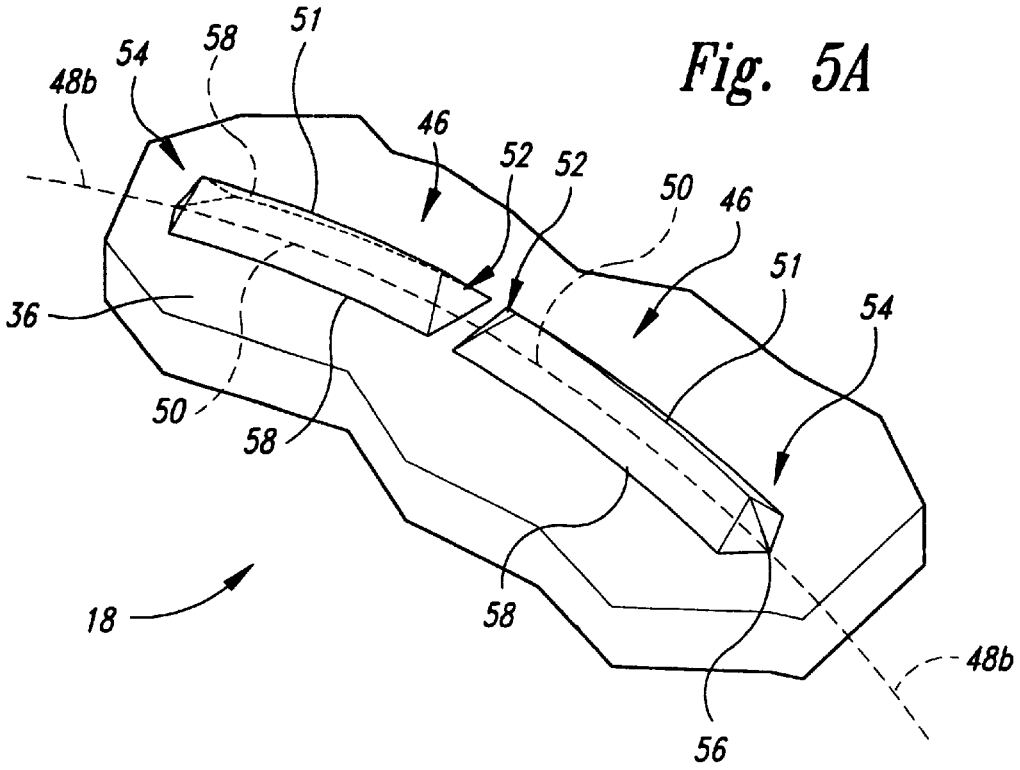
FIG. 5A is an enlarged isometric view of a portion of a sole having traction elements in accordance with an embodiment of the invention.
Figure 5B:
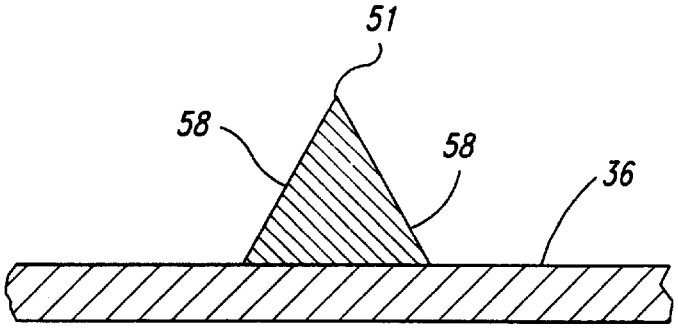
FIG. 5B is a cross-sectional view of one of the traction elements shown in FIG. 5A.
Figure 5C:
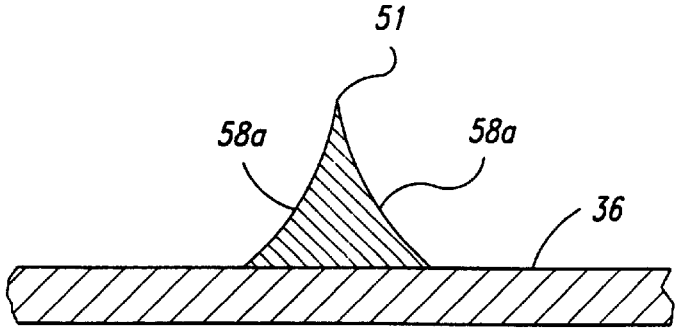
FIG. 5C is a cross-sectional view of a traction element in accordance with an alternate embodiment of the invention.

As discussed above, the traction members 22 may comprise elongated traction elements 46, which are shown in greater detail in FIG. 5A. The traction elements 46 are each elongated along an element axis 50. The traction elements 46 preferably have an overall length of approximately one inch and an overall width of approximately 0.20 inch. The traction elements 46 may have other lengths, as shown in FIGS. 4A–B, depending upon the particular location of the individual traction element. Traction elements 46 which form a transverse traction member 22*b* are preferably positioned such that the element axis 50 of each traction element 46 coincides with the transverse traction member axis 48*b*, as shown in FIG. 5A. The element axes 50 of traction elements 46 forming an axial traction member 22*a* preferably coincide with the axial traction member axis 48*a* (FIGS. 4A–B).

Each traction element 46 has a ridge 51 which is preferably pointed so as to easily engage with and grip the golf course terrain, providing traction and stability. In a preferred embodiment, the ridge 51 is positioned approximately 0.20 inch from the lower surface 36 of the sole 18 such that the overall height of the traction elements is 0.20 inch. In other embodiments, the ridge 51 may be positioned a greater or lesser distance from the lower surface 36 to achieve the desired level of traction.

Each traction element 46 further includes a first end portion 52 and a second end portion 54 opposite the first end portion. The first and second end portions 52 and 54 of adjacent traction elements 46 are preferably canted away from each other as they extend away from the lower surface 36 of the sole 18. The end portions 52 and 54 accordingly resist the tendency to trap dirt and other particles between adjacent traction elements 46 because dirt or other particles will tend to fall away from the gaps between the traction elements as the sole 18 is moved away from the ground. Where the first end portion 52 is adjacent another traction element 46, it may be flat so as to further reduce any tendency for dirt to become trapped between adjacent traction elements 46. Where the second end portion 54 is not adjacent another traction element 46, it may have an end ridge line 56, as shown in FIG. 5A, to further improve traction.

Each traction element 46 includes two elongated side surfaces 58 which are generally parallel to the element axis 50. The side surfaces 58 may be longer or shorter than shown in FIG. 5A, as discussed above, so long as a side surface area of each traction element 46 tends to impede the motion of the sole transverse to the element axis 50 when the traction element is engaged with the ground. In one embodiment, the side surfaces 58 may be flat and canted toward each other as they extend away from the lower surface 36. Accordingly, the traction elements 46 have a flat-sided triangular cross-sectional shape, as shown in FIG. 5B, which may further reduce the tendency for dirt to become trapped against the traction elements. In another embodiment, shown in FIG. 5C, the side surfaces 58*a* may have a curved shape. As shown in FIG. 5C, the curved side surfaces 58*a* are canted toward each other as they extend away from the lower surface 36 to prevent dirt from becoming entrapped against the traction elements 46, as discussed above with reference to FIG. 5B.

Figure 6A:
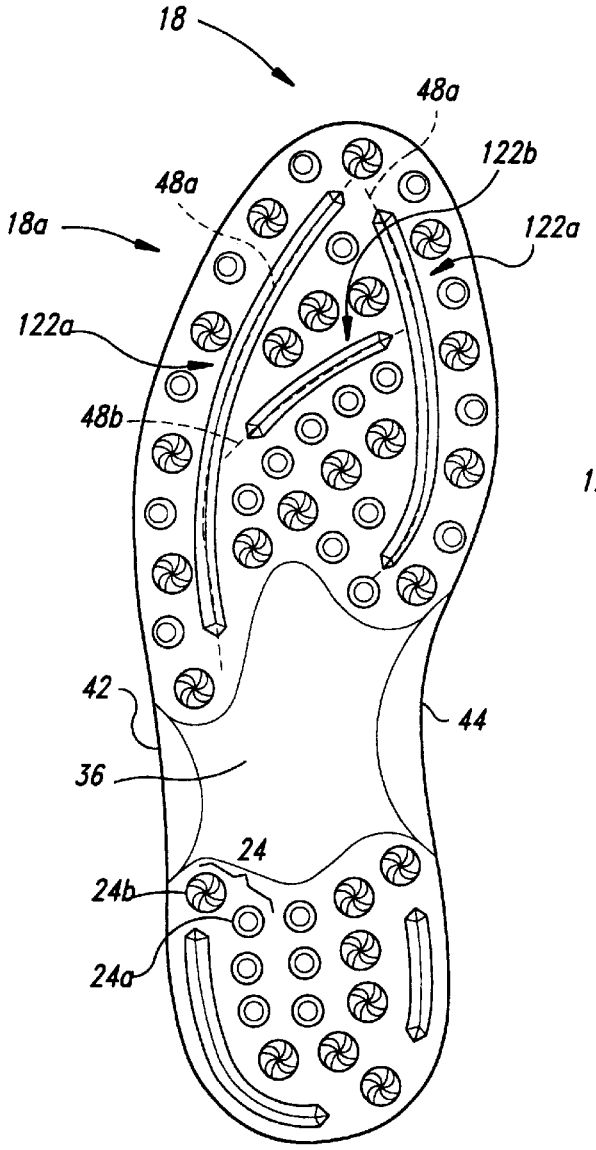
FIG. 6A is a bottom plan view of the lower surface of a right sole in accordance with another embodiment of the invention.
Figure 6B:
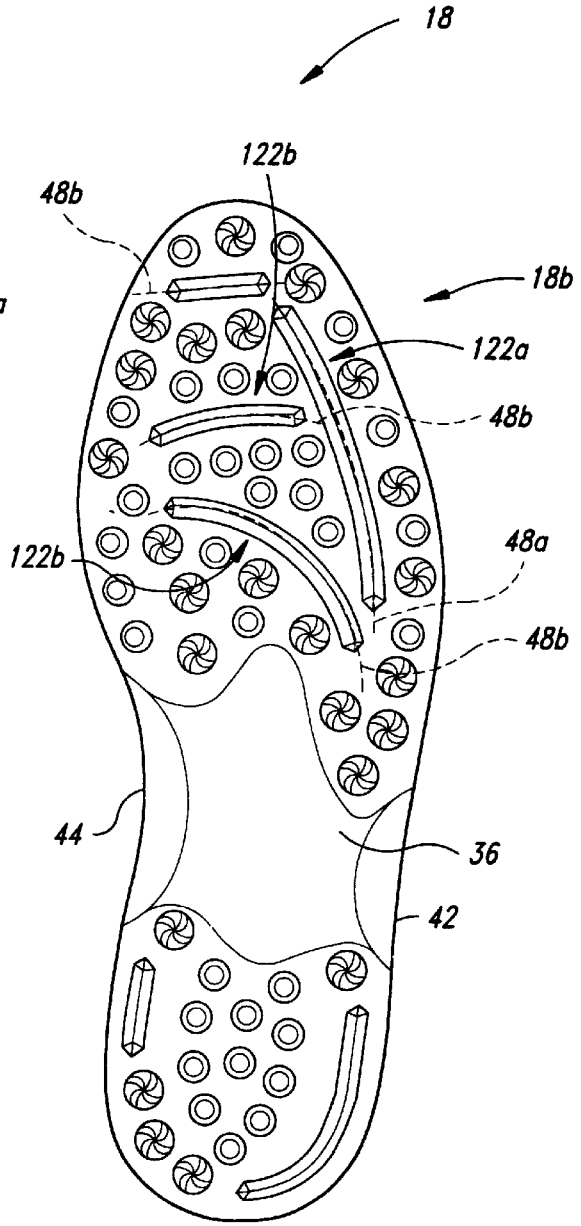
FIG. 6B is a bottom plan view of the lower surface of a left sole in accordance with another embodiment of the invention.

FIGS. 6A–B are plan views of a right sole 18*a* and left sole 18*b*, respectively, having continuous traction members 122*a* and 122*b* in accordance with another embodiment of the invention. As shown in FIGS. 6A–B, the traction members 122*a* and 122*b* are oriented generally as shown in FIGS. 3A–B but comprise single, continuous elements rather than a plurality of discrete elements. An advantage of the continuous traction members 122*a* and 122*b* when compared to traction members 22 comprising discrete traction elements 46 is that the traction members 122*a* and 122*b* may provide a greater degree of stability and resistance to motion transverse to the respective traction member axes 48*a* and 48*b*. Conversely, an advantage of the traction elements 46 shown in FIGS. 5A–5C is that the first and second end portions 52 and 54 of the traction elements may provide a greater degree of surface area with which to engage the golf course terrain and may accordingly provide better traction.

As shown in FIG. 6B, the axial traction member 122*a* on the left sole 18*b* may be positioned adjacent to the outside edge 42 rather than the inside edge 44, as was shown in FIG. 4B, without significantly affecting the performance of the left sole. In other embodiments, the traction members 122*a* and 122*b* may have other locations on the lower surfaces 36 of the soles 18, so long as they provide the desired level of stability and pivotability, respectively.

Figure 7A:
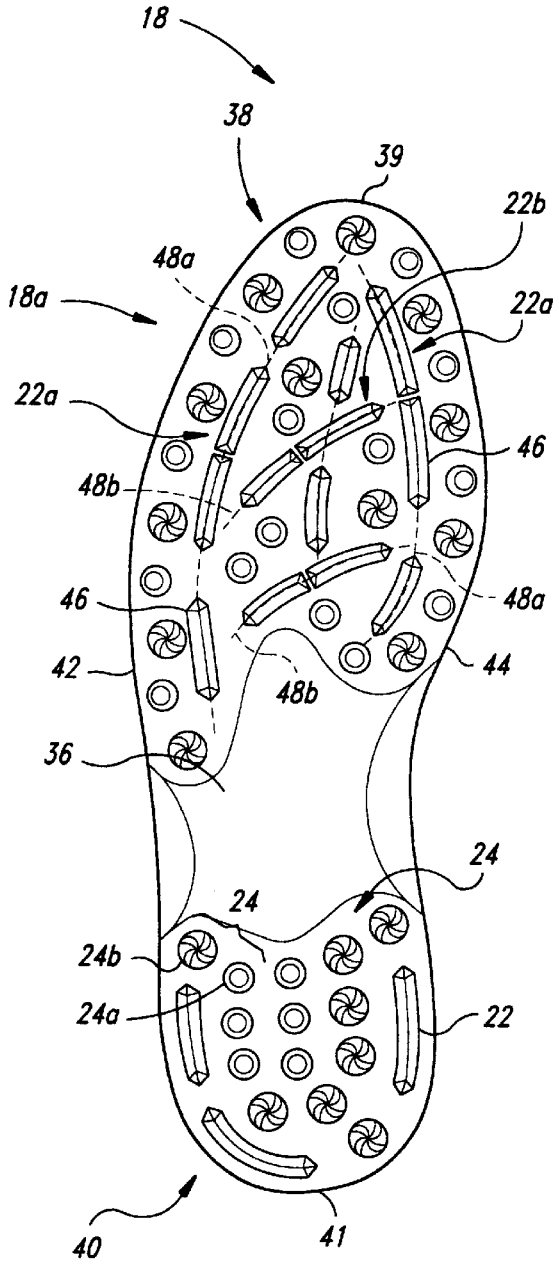
FIG. 7A is a bottom plan view of the lower surface of a sole in accordance with still another embodiment of the invention.
Figure 7B:
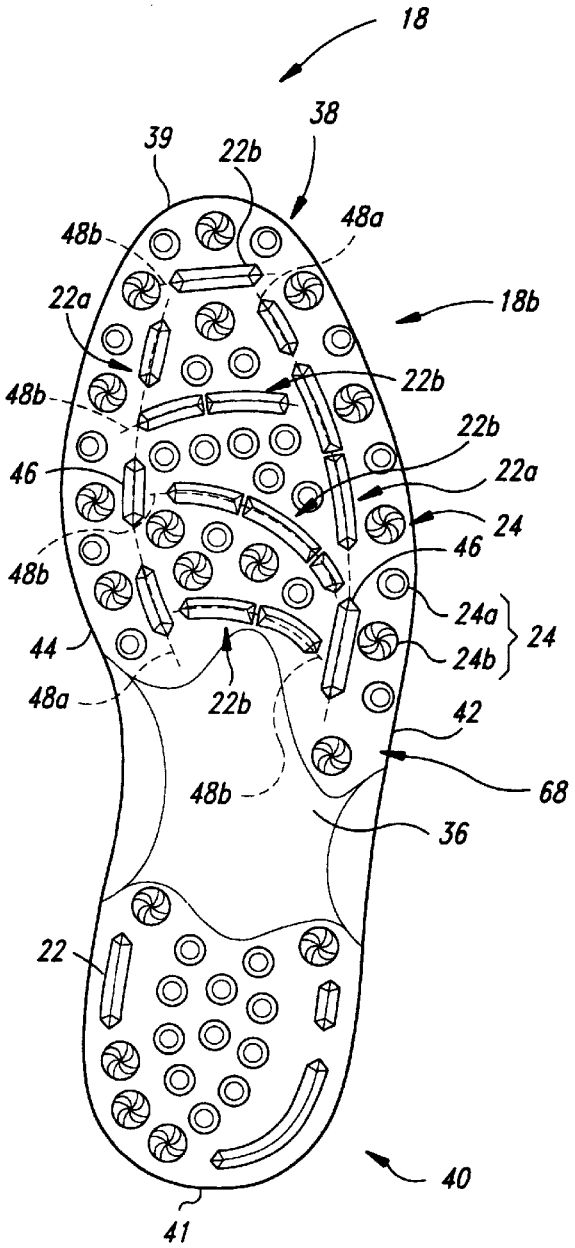
FIG. 7B is a bottom plan view of the lower surface of a sole in accordance with still another embodiment of the invention.

FIGS. 7A–B illustrate yet another embodiment of the golf shoe soles 18 having a greater number of traction members 22 than are shown in FIGS. 4A–B. The right sole 18*a* shown in FIG. 7A has three axial traction members 22*a* and two transverse traction members 22*b*. Because the number of axial traction members 22*a* exceeds the number of transverse traction members 22*b*, the right sole 18*a* shown in FIG. 7A tends to resist pivotal motion of the right shoe 12 to which the right sole is attached. In a similar fashion, the left sole shown in FIG. 7B has two axial traction members 22*a* and four transverse traction members 22*b*. Because the number of transverse traction members 22*b* exceeds the number of axial traction members 22*a*, the left sole 20 shown in FIG. 7B tends to allow pivotal motion of the felt shoe 14 to which the left sole is attached. In other embodiments, the right and left soles 18*a* and 18*b* may have a greater or lesser number of axial traction members 22*a* and transverse traction members 22*b*, so long as the number of axial traction members exceeds the number of transverse traction members for soles intended to provide resistance to pivotal motion, and the number of transverse traction members exceeds the number of axial traction members for soles intended to provide increased stability and less resistance to pivotal motion.

In still further embodiments, the number of axial traction members 22*a* need not exceed the number of transverse traction members 22*b* for a sole providing resistance to pivotal motion, so long as the surface area of the axial traction members 22*a* aligned with the axial traction member axes 48*a* is sufficient to resist pivotal motion of the sole to which the traction elements 46 are attached. In a similar fashion, the transverse traction members 22*b* need not outnumber the axial traction members 22*a* if the surface area of the axial traction members 22*a* aligned with the axial traction member axes 48*a* is sufficiently small so as not to impede the pivotal motion of a sole which is configured to allow pivotal motion.

As discussed previously with reference to FIGS. 3A–B and 4A–B, the soles 18 include cleat members 24 which depend from the lower surface 36 of the soles. The cleat members 24 include flat cleat members 24*a* and rounded cleat members 24*b*. The flat cleat members 24*a* are generally provided to enhance the stability of the sole to which they are attached, and the rounded cleat members 24*b* are generally provided to enhance pivotability of the soles to which the are attached, as discussed below with reference to FIGS. 8A–8D.

Figure 8A:
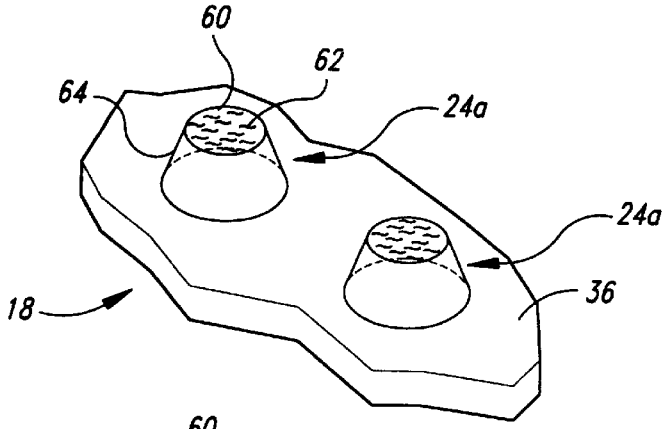
FIG. 8A is an enlarged isometric view of a portion of a sole having flat cleat members in accordance with an embodiment of the invention.

Referring to FIG. 8A, the flat cleat members 24*a* have an end surface 60 which is generally parallel to the lower surface 36 of the sole. The end surface 60 may include roughness elements 62 which enhance the ability of the flat cleat members 24*a* to grip smooth surfaces. The flat cleat members 24*a* accordingly provide stability to the sole from which the flat cleat members depend, which may be particularly advantageous when the sole is used on flat smooth surfaces, such as hard floors. The flat cleat members 24*a* may also be positioned on portions of the sole which are preferably kept stable during the golfer's swing. Accordingly, the flat cleat members 24*a* may be concentrated in a central region 63 of the toe portion 38 of the left sole 18*b*, as shown in FIG. 4B to stabilize the central region during a right-handed golfer's swing. Because a typical right-handed golfer may shift 90% of his or her weight to the outside of the left shoe 14 at the conclusion of the swing, the concentration of flat cleat members 24*b* in the central region 63, and particularly near the outer edge 44, may improve the support of the golfer's feet. The flat cleat members 24*a* may be concentrated on the right sole 18*a* in a similar manner for left-handed golfers.

The flat cleat member 24*a* further includes a side surface 64 which may be partially conical as shown in FIG. 8A. The conical side surface 64 allows the flat cleat member 24*a* to penetrate some distance into the golf course terrain, providing for increased traction. The side surface 64 is canted in a manner similar to that discussed previously with respect to the traction elements 46 shown in FIG. 5A, so as to inhibit the tendency for the flat cleat members 24*a* to retain dirt, sod or other detritus.

In a preferred embodiment, the flat cleat members 24*b* have a generally circular cross-sectional shape which tapers from a diameter of approximately 0.40 near the lower surface 36 of the sole 18 to a diameter of approximately 0.25 inch near the end surface 60. The overall height of the flat cleat members is approximately 0.15–0.20 inch, though cleat members having heights outside this range may be used in alternate embodiments.

Figure 8B:
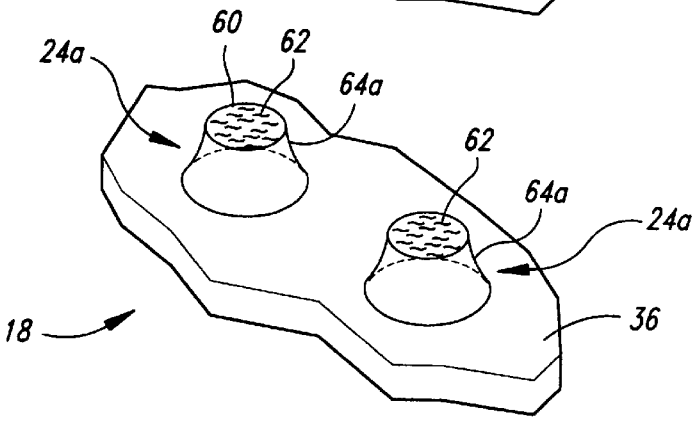
FIG. 8B is an enlarged isometric view of another embodiment of the flat cleat members shown in FIG. 8A.
Figure 8C:
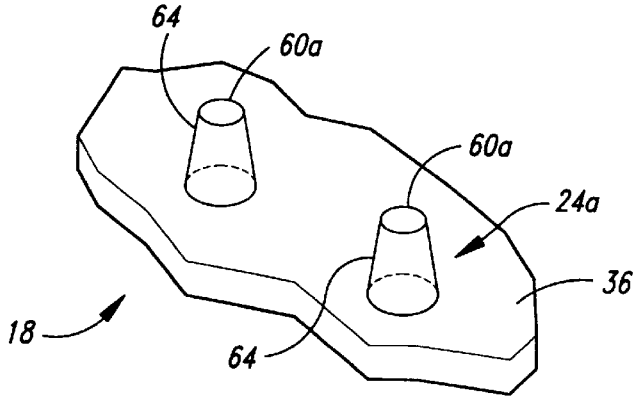
FIG. 8C is an isometric view of yet another embodiment of the flat cleat members shown in FIG. 8A.

In another embodiment shown in FIG. 8B, the flat cleat members 24*a* may include curved side surfaces 64*a*. The curved side surfaces 64*a* are canted in a manner similar to that discussed previously with reference to FIG. 8A so as to reduce the tendency for the flat cleat members 24*a* to retain dirt particles. In other embodiments, the flat cleat members 24*a* may have side surfaces having other shapes which similarly tend to shed dirt particles. In yet another embodiment, shown in FIG. 8C, the flat cleat members 24*a* have conical side surfaces 64 and a smaller end surface 60*a* than is shown in FIG. 8A. The flat cleat members 24*a* shown in FIG. 8C may accordingly provide a greater deal of penetration into the terrain while providing a lesser degree of stability. A greater number of flat cleat members 24*a* of the type shown in FIG. 8C may accordingly be used to provide the same level of stability as the flat cleat members shown in FIG. 8C. In still other embodiments, the flat cleat members 24*a* may have other shapes which also provide for stability, traction, and a low affinity for dirt particles.

Figure 8D:
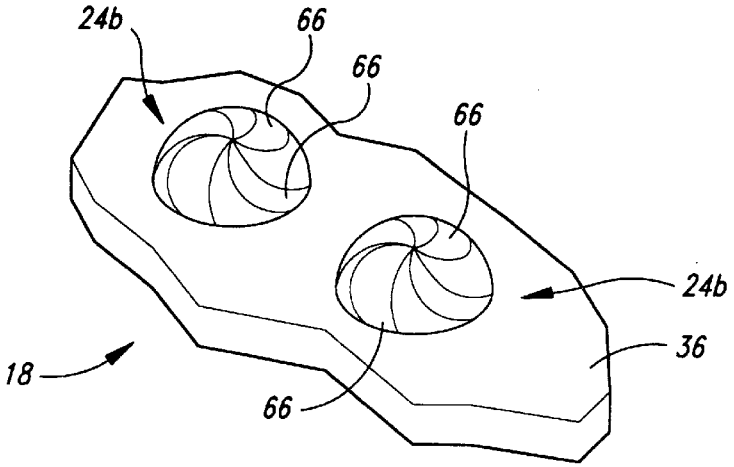
FIG. 8D is an isometric view of a portion of a sole having rounded cleat members in accordance with an embodiment of the invention.

The rounded cleat members 24*b* are shown in greater detail in FIG. 8D. The rounded cleat members 24*b* have flutes or grooves 66 formed therein which may have an arcuate shape, as shown in FIG. 8D, or may have other shapes in other embodiments. The flutes or grooves 66 may enhance the traction provided by the rounded cleat members 24*b* by increasing the surface area of the rounded cleat members which is available to engage the terrain. The rounded cleats 24*b* have a diameter near the lower surface 36 of the sole 18 of approximately 0.5 inch and an overall height of approximately 0.20 inch. Accordingly, the heights of the traction elements 46, flat cleat members 24*a* and rounded clear members 24*b* are approximately equal in a preferred embodiment, though variations are possible in other embodiments.

The overall shape of the rounded cleat members 24*b* is rounded or hemispherical in a preferred embodiment. In other embodiments, the rounded cleat members 24*b* may have other generally curved overall shapes. The golfer may accordingly roll the golfer's foot more easily off the rounded cleat members 24*b* than the flat cleat members 24*a* or the traction members 22. In one embodiment, a greater number of rounded cleat members 24*b* may be provided near the inside edge 44 of the left sole 18*b*, as shown in FIGS. 3B and 4B. The concentration of rounded cleat members 24*b* in this region may allow a right-handed golfer to more easily rotate his or her weight toward the inside edge 44 of the left sole 18*b* while following through the swing. Similarly, the rounded cleat members 24*b* may be concentrated toward the outside edge 42 of a rear part 68 of the toe portion 38 of the left sole 18*b* to allow the golfer to more easily roll away from the outside edge and toward the inside edge 44. For left-handed golfers, the concentrations of rounded cleat members 24*b* discussed above may be provided on the right sole 18*a* rather than the left sole 18*b*.

An advantage of the flat cleat members 24*a* is that they tend to stabilize the golf shoe to which they are attached. At the same time, the flat cleat members 24*a* may penetrate the surf slightly, providing for an increased degree of traction. An advantage of the rounded cleat members 24*b* is that they allow the golfer to more easily pivot or rotate his or her weight from one portion of the shoe to another. Such a rotational or pivotal motion is desirable during the golf swing so the golfer may more easily follow through during the swing, shifting his weight to impart more power to the ball.

In a manner similar to that discussed above with reference to the traction members 22*a* and 22*b* shown in FIGS. 3A–B and 4A–B, the flat cleat members 24*a* and rounded cleat members 24*b* may be used in combination to provide a level of stability and pivotability in the same shoe. The flat cleat members 24*a* may concentrated in regions of the sole where stability is of increased importance and the rounded cleat members 24*b* may be concentrated in regions where pivotability is of increased importance. Furthermore, the flat cleat members 24*a* and rounded cleat members 24*b* may be arranged in combination with the axial traction members 22*a* and transverse traction members 22*b*, as shown in FIGS. 3A–B, 4A–B, 6A–B and 7A–B. The foregoing components may be advantageously arranged to emphasize stability or pivotability, in a manner which may depend on the particular portion of the shoe to which the components are attached, and which may be tailored to account for the dexterity of the golfer.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A pair of soles for golf shoes, comprising:

first and second soles, each having a heel portion, a toe portion forward of the heel portion, a first edge extending between the heel and toe portions and a second edge extending between the heel and toe portions opposite the first edge; and a plurality of traction members, each elongated along a traction member axis, the plurality of traction members including at least one first traction member connected to and depending from the first sole, the traction member axis thereof being generally transverse to least one of the first and second edges of the first sole, at least two second traction members connected to and depending from the first sole, the traction member axes thereof being aligned generally parallel with at least one of the edges of the first sole, a number of second traction members being greater than a number of first traction members to resist pivotal motion of the first sole relative to the ground, at least one third traction member connected to and depending from the second sole, the traction member axis thereof being aligned generally parallel with at least one of the edges of the second sole, and at least two fourth traction members connected to and depending from the second sole, the traction member axes thereof being generally transverse to least one of the first and second edges of the second sole, a number of fourth traction members being greater than a number of third traction members to allow pivotal motion of the second sole relative to the ground.

2. The soles of claim 1 wherein the first sole is sized and shaped to be attached to a right shoe and the second sole is sized and shaped to be attached to a left shoe.

3. The soles of claim 1 wherein the first sole is sized and shaped to be attached to a left shoe and the second sole is sized and shaped to be attached to a right shoe.

4. The soles of claim 1 wherein at least one of the traction members comprises a plurality of spaced apart traction elements, each traction element being elongated along the traction member axis.

5. The soles of claim 1 wherein at least one of the traction members has a tapered cross-sectional shape when cut by a plane generally perpendicular to the traction member axis, the tapered shape having a narrow portion spaced away from the sole to which traction member is connected.

6. The soles of claim 5 wherein the tapered cross-sectional shape is generally triangular.

7. The soles of claim 1, further comprising at least one cleat member connected to and depending from at least one of the first and second soles to support the at least one of the first and second soles.

8. The soles of claim 7 wherein the cleat member has a tapered cross-sectional shape when cut by a plane generally perpendicular to the at least one of the first and second soles, the tapered shape having a narrow portion spaced away from the at least one of the first and second soles.

9. The soles of claim 7 wherein the cleat member has a generally circular cross-sectional shape when cut by a plane generally parallel to the at least one of the first and second soles.

10. The soles of claim 7 wherein the cleat member has a generally rounded cross-sectional shape when cut by a plane generally perpendicular to the at least one of the first and second soles.

11. The soles of claim 7 wherein the cleat member has a fluted surface.

12. The soles of claim 7 wherein the cleat member is positioned intermediate one of the traction members and an edge of one of the first and second soles with which the one traction member is aligned.

13. The soles of claim 1, further comprising a plurality of cleat members connected to and depending from at least one of the first and second soles to support the at least one of the first and second soles, the plurality of cleat members being aligned with one of the plurality of traction members.

14. The soles of claim 13 wherein the plurality of cleat members are positioned intermediate the one traction member and an edge of the one sole proximate the one traction member.

15. The soles of claim 1 wherein at least one of the first and second edges of at least one of the first and second soles is at least partly curved.

16. The soles of claim 1 wherein at least one of the traction members has a first end portion and a second end portion opposite the first end portion, the first and second end portions each having a tapered shape tapering from a wide region adjacent the sole to which the one traction member is connected to a narrow region spaced apart from the sole to which the traction member is connected, the narrow regions of the first and second end portions being canted toward each other.

17. The soles of claim 1 wherein at least one traction member has a first and second end portion positioned on the traction member axis, the first end portion being opposite the second end portion, the traction member being continuous between the first and second end portions.

18. The soles of claim 1 wherein at least one traction member is integrally formed with one of the first and second soles.

19. A pair of soles for golf shoes, comprising:

a first heel portion attachable to a first golf shoe, the first golf shoe being one of a right shoe and a left shoe, the first heel portion having a first edge, a second edge opposite the first edge and a third edge intermediate the first and second edges;

a second heel portion attachable to a second golf shoe, the second golf shoe being the other of the right shoe and the left shoe, the second heel portion having a first edge, a second edge opposite the first edge and a third edge intermediate the first and second edges;

a first traction member connected to and depending from the first heel portion, the first traction member being elongated along a first axis generally aligned with at least one of the edges of the first heel portion, the first traction member being positioned proximate at least one of the edges of the first heel portion;

a plurality of first cleat members connected to and depending from the first heel portion, the first cleat members defining a second axis aligned with and proximate to at least one of the edges of the first heel portion, the first cleat members being spaced apart to allow pivotal motion of the first heel portion;

a plurality of spaced apart second cleat members connected to and depending from the second heel portion; and a second traction member connected to and depending from the second heel portion, the second traction member being elongated along a third axis generally aligned with at least one of the edges of the second heel portion, the second traction member being positioned proximate at least one of the edges of the second heel portion and intermediate the one edge and the plurality of second cleat members to stabilize the second heel portion, a first arrangement of the first cleat members and the first traction member being different than a second arrangement of the second cleat members and the second traction member such that the first arrangement is not a mirror image of the second arrangement.

20. The soles of claim 19 wherein the first heel portion is sized and shaped to be attached to a left shoe and the second heel portion is sized and shaped to be attached to a right shoe.

21. The soles of claim 19 wherein the first heel portion is sized and shaped to be attached to a right shoe and the second heel portion is sized and shaped to be attached to a left shoe.

22. The soles of claim 19, wherein the at least one of the first and second traction member comprises two spaced apart elongated traction elements.

23. A pair of athletic shoes, comprising:

a first shoe having a first upper portion attached to a first sole, the first shoe being one of a right shoe and a left shoe, the first sole having a heel portion, a toe portion forward of the heel portion, a first edge extending between the heel and toe portions, a second edge extending between the heel and toe portions opposite the first edge;

a second shoe having a second upper portion attached to a second sole, the second shoe being the other of the right shoe and the left shoe, the second sole having a heel portion, a toe portion forward of the heel portion, a first edge extending between the heel and toe portions, a second edge extending between the heel and toe portions opposite the first edge; and a plurality of traction members, each elongated along a traction member axis, the plurality of traction members including at least one first traction member connected to and depending from the first sole, the traction member axis thereof being generally transverse to at least one of the first and second edges of the first sole, at least two second traction members connected to and depending from the first sole, the traction member axes thereof being aligned generally parallel with at least one of the edges of the first sole, a total number of second traction members being greater than a total number of first traction members to resist pivotal motion of the first sole relative to the ground, at least one third traction member connected to and depending from the second sole, the traction member axis thereof being aligned generally parallel with at least one of the edges of the second sole, and at least two fourth traction members connected to and depending from the second sole, the traction member axes thereof being generally transverse to at least one of the first and second edges of the second sole, a total number of fourth traction members being greater than a total number of third traction members to allow pivotal motion of the second sole relative to the ground.

24. The shoes of claim 23 wherein the first shoe is a right shoe and the second shoe is a left shoe.

25. The shoes of claim 23 wherein the first shoe is a left shoe and the second shoe is a right shoe.

26. The shoes of claim 23 wherein at least one of the traction members has a tapered cross-sectional shape when cut by a plane generally perpendicular to the traction member axis thereof, the tapered shape having a narrow portion spaced away from the sole to which the traction member is connected.

27. The shoes of claim 23 wherein at least one of the traction members is fixedly attached to the first sole, the traction member extending away from the sole to which it is connected in a direction substantially normal to the sole and including an at least partially flexible material that is bendable away from the normal direction.

28. A pair of athletic soles, comprising:

a first sole and a second sole, each having a heel portion, a toe portion forward of the heel portion, a first edge extending between the heel and toe portions and a second edge extending between the heel and toe portions opposite the first edge, the first sole being one of a left sole and a right sole, the second sole being the other of the left sole and the right sole;

a plurality of traction elements connected to and depending from each sole, each traction element being elongated along an element axis and having a surface area aligned with the element axis thereof, traction elements in a first group of the plurality of traction elements being substantially aligned with at least one of the first and second edges of the first sole to resist pivotal motion of the first sole, traction elements in a second group of the plurality of traction elements having the element axes thereof extending between the first and second edges of the second sole to allow pivotal motion of the second sole, a combined surface area of the traction elements of the first group being different than a combined surface area of the traction elements of the second group, the total number of traction elements depending from the first sole forming a first arrangement, the total number of traction elements depending from the second sole forming a second arrangement different than the first arrangement such that the first arrangement is not a mirror image of the second arrangement.

29. A pair of golf shoes, comprising:

a first shoe having a first sole, the first sole having a heel portion, a toe portion forward of the heel portion, a first edge extending between the heel and toe portions and a second edge extending between the heel and toe portions opposite the first edge, the first sole further having a plurality of first traction elements connected to and depending therefrom, each first traction element being elongated along a first element axis and having a surface area aligned with the first element axis, the plurality of first traction elements including a first group and a second group, first traction elements of the first group having the element axes thereof generally aligned with at least one of the first and second edges of the first sole to resist pivotal motion of the first sole, first traction elements of the second group having the element axes thereof being generally transverse to at least one of the first and second edges of the first sole to allow pivotal motion of the first sole, a combined surface area of the first traction elements of the first group being greater than a combined surface area of the first traction elements of the second group to resist pivotal motion of the first sole; and a second shoe having a second sole, the second sole having a heel portion, a toe portion forward of the heel portion, a first edge extending between the heel and toe portions and a second edge extending between the heel and toe portions opposite the first edge, the second sole having a plurality of second traction elements connected to and depending therefrom, each second traction element being elongated along a second element axis and having a surface area aligned with the second element axis, the plurality of second traction elements including a first group and a second group, second traction elements of the first group having the element axes thereof generally aligned with at least one of the first and second edges of the second sole to resist pivotal motion of the second sole, and second traction elements of the second group having the clement axes thereof being generally transverse to at least one of first and second edges of the second sole to allow pivotal motion of the second sole, a combined surface area of the traction elements of the second group being greater than a combined surface area of the traction elements of the first group to allow pivotal motion of the second sole.

30. A pair of shoe soles for athletic shoes, comprising:

a first base portion defining a first base portion plane;

a first plurality of projections comprising at least one traction member elongated in a direction generally parallel to the first base portion plane and at least one cleat member, the first plurality of projections being fixedly attached to the first base portion, the first plurality of projections depending from the first base portion and extending away from the first base portion in a direction generally normal to the first base portion plane;

a second base portion defining a second base portion plane; and a second plurality of projections comprising at least one traction member elongated in a direction generally parallel to the second base portion plane and at least one cleat member, the second plurality of projections being fixedly attached to the second base portion, the second plurality of projections depending from the second base portion and extending away from the second base portion in a direction generally normal to the second base portion plane, a first arrangement of the first plurality of projections being different than a second arrangement of the second plurality of projections such that the first arrangement is not a mirror image of the second arrangement.

31. The shoe sole of claim 30 wherein the at least one cleat member has a generally circular cross-sectional shape when cut by a plane generally parallel to the base portion plane.

32. The shoe sole of claim 30 wherein at least one of the projections comprises a rubber material.

33. A method for controlling motion of a golfer's feet, comprising:

coupling at least one first elongated traction member to a first foot of the golfer, the first elongated traction member being elongated generally transverse to an edge of the first foot and coupling number of second elongated traction members to the first foot of the golfer, the second elongated traction members being elongated generally parallel with an edge of the first foot, the number of second elongated traction members being greater than a number of first elongated traction members;

coupling at least one third elongated traction member to a second foot of the golfer, the third elongated traction member being elongated generally parallel with an edge of the second foot and coupling a number of fourth elongated traction members to the second foot, the fourth elongated traction members being elongated generally transverse to an edge of the second foot, the number of fourth elongated traction members being greater than a number of third elongated traction members; and engaging the elongated traction members with the ground when the golfer swings a golf club, to resist pivotal motion of the first foot and allow pivotal motion of the second foot.

34. The method of claim 33 wherein the step of coupling the first elongated traction members and coupling the second elongated traction members includes providing the first and second elongated traction members on a sole of a shoe and placing the shoe on the first foot.

35. The method of claim 33 wherein the golfer has a right-handed swing and the step of coupling the first and second elongated traction members includes coupling the first and second elongated traction members to the right foot of the golfer and the step of coupling the third and fourth elongated traction members includes coupling the third and fourth elongated traction members to the left foot of the golfer.

36. The method of claim 33 wherein the golfer has a left-handed swing and the step of coupling the first and second elongated traction members includes coupling the first and second elongated traction members to the left foot of the golfer and the step of coupling the third and fourth elongated traction members includes coupling the third and fourth elongated traction members to the right foot of the golfer.

37. The method of claim 33, further comprising coupling lug members to at least one of the first and second feet to stabilize the one of the first and second feet when the golfer walks.

* * * * *